United States Patent [19]

Oase

[11] 4,167,086

[45] Sep. 11, 1979

[54] ECCENTRICITY ELIMINATING CABLE-FABRIC CONNECTION APPARATUS FOR AIR SUPPORTED ROOF STRUCTURES

[75] Inventor: Vernon S. Oase, Toledo, Ohio

[73] Assignee: Owens-Corning Fiberglas Corporation, Toledo, Ohio

[21] Appl. No.: 918,225

[22] Filed: Jun. 23, 1978

[51] Int. Cl.[2] ..... E04B 1/345

[52] U.S. Cl. ..... 52/2

[58] Field of Search ..... 52/2

[56] References Cited

U.S. PATENT DOCUMENTS

| | | | |
|---|---|---|---|
| 1,402,077 | 1/1922 | Lanchester | 52/2 |
| 3,116,746 | 1/1964 | Bird | 52/2 |
| 3,619,957 | 11/1971 | Adam | 52/2 |
| 3,638,368 | 2/1972 | Pierson | 52/2 |
| 3,744,191 | 7/1973 | Bird | 52/2 |
| 3,777,425 | 12/1973 | Le Bougeois | 52/2 |
| 3,835,599 | 9/1974 | Geiger | 52/2 |
| 3,924,363 | 12/1975 | Candle | 52/2 |
| 3,965,546 | 6/1976 | Hickle | 52/2 |
| 3,975,915 | 8/1976 | Haw | 52/2 |

OTHER PUBLICATIONS

Profile of the Two Largest Air Supported Roofs Archit., Rec. 159, 141-144, Jan. 1979.

Largest and Lightest Fabric Roof to Date, D. H. Geiger Civil Eng. 45:82-86, Nov. 1975.

*Primary Examiner*—John E. Murtagh

*Attorney, Agent, or Firm*—Ronald C. Hudgens; Philip R. Cloutier; Paul J. Rose

[57] ABSTRACT

An assembly for pivotally connecting both the roof fabric and the restraining cables of an air-supported roof for pivotal movement about a common axis at a supporting structure such as a compression ring. A frame for attachment of the fabric is mounted co-pivotally with a cable attachment member and provides a continuous coupling of the roof fabric around the cable connection to avoid stress concentrations and the like. A flexible boot is provided for covering the connector assembly.

16 Claims, 10 Drawing Figures

FIG. 3
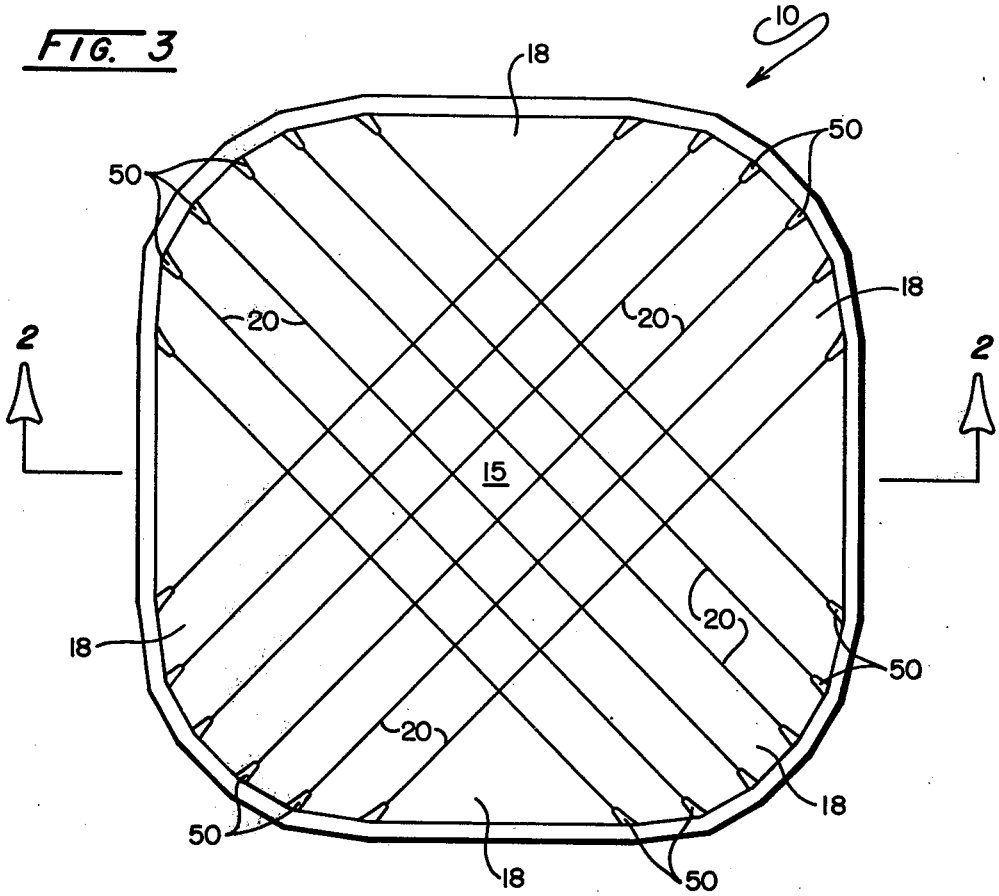
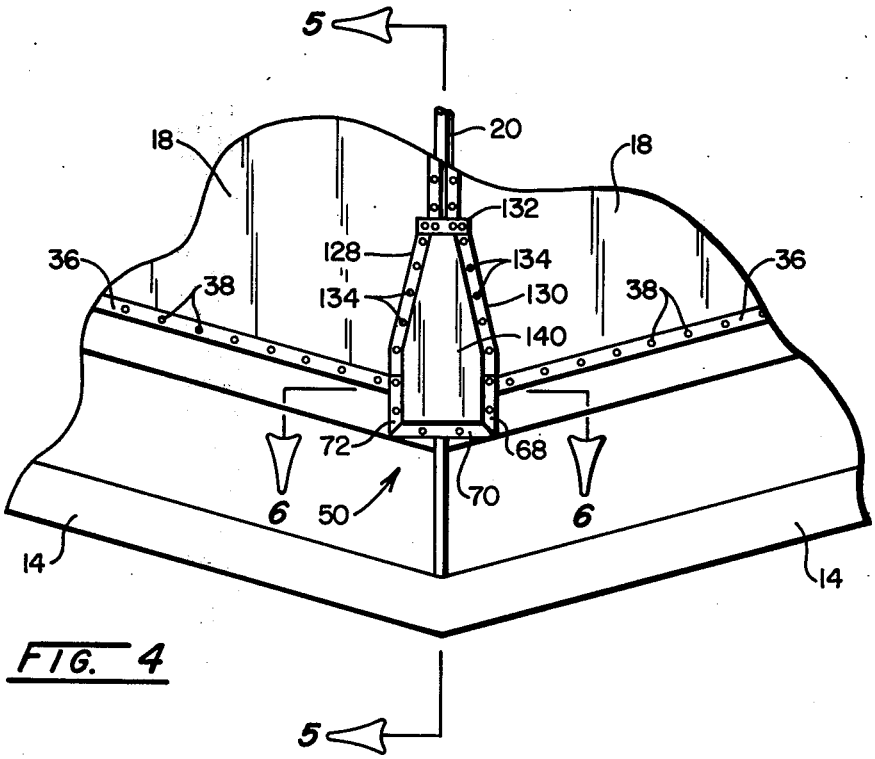
FIG. 4

FIG. 7
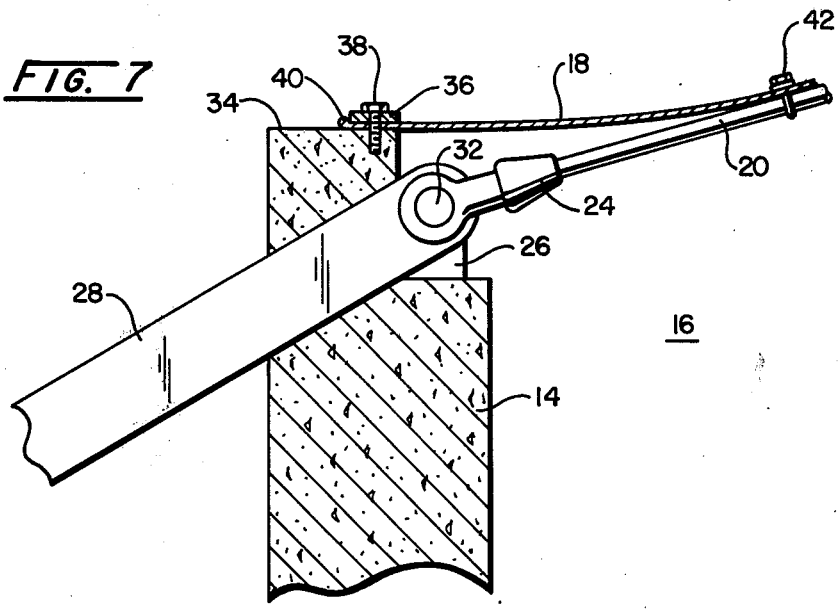
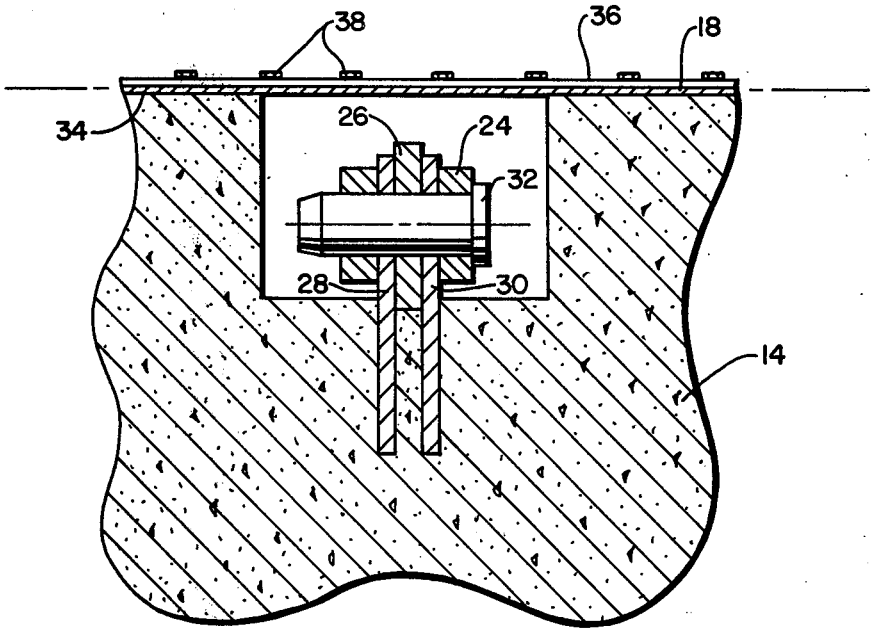
FIG. 8

ECCENTRICITY ELIMINATING CABLE-FABRIC CONNECTION APPARATUS FOR AIR SUPPORTED ROOF STRUCTURES

BACKGROUND OF THE INVENTION

The U.S. Pavilion at the 1970 Japan Exposition in Osaka was designed and fabricated as an air-supported glass fiber reinforced membrane structure. Designer interest considered to have been generated as a consequence of this structure has led to the application of air-supported envelopes as roof coverings over the broad expanses, for example, of stadiums and similar arenas. Such roof structures generally are configured as a continuous fabric formed of a resin coated glass fiber material which extends over the arena from a continuous, substantially air secure attachment to a correspondingly continuous compression ring or equivalent supporting structure. This latter compression ring is supported about the top of the peripheral walls of the stadium being enclosed. To restrain the roof web in its designed geometric configuration, a cable system is employed wherein a series of cables extend across the expanse to be covered between predetermined points located upon the compression ring. Several approaches to the structural optimization of the geometric pattern defined by these cables have been developed. See for example, a "skewed symmetry" approach by Geiger, U.S. Pat. No. 3,835,599; or the design of Bird, U.S. Pat. No. 3,744,191.

During erection of the roof structure, the cables are coupled to pivotal connectors structurally attached to the compression ring. Upon essential completion of cable erection, panels of the somewhat flexible glass fiber roof membrane are connected to the compression ring and cables utilizing air secure clamps or the like. During this procedure, the assembly is "down," the cables hanging across the arena in catenary fashion. Upon completion of fabric attachment, a plurality of fans installed within the thus enclosed building are activated to build up the air pressure to predetermined levels depending upon ambient environmental conditions, as well as the design strength of portals and windows within the building structure. As these pressures develop the roof structure is raised to its operational orientation.

An appreciation of the material stress factors enncountered in the design of the air-supported roof structures may be gleaned merely in considering the sizes and weight scales involved in typical installations. For example, the Pontiac Metropolitan Stadium, Pontiac, Mich. is roofed by a cable restrained air-supported roof spanning 722 feet (220 m). Together with the compression ring, the roof cavern of that arena covers ten acres, incorporating eighteen 3-inch diameter cables, the longest of which is 747 feet (227.7 m) in length and weighs 16,000 pounds (7 Mg.). Upon inflation, the rise at the center of the roof is 50 feet.

The structural design approach to such roofs necessarily must look to an avoidance of the development of stress gradients, i.e. stress concentrations at various regions of the fabric and cable structure. In the past, such stress anomalies have been witnessed particularly at those points about the compression ring where both a cable end is coupled and the roof membrane is continuously connected to the ring in air secure fashion. Normally, the pivot axis of the cable coupling is not at the same height as the connection of the roof membrane or fabric to the compression ring in the vicinity of the cable, the cable coupling usually being spaced vertically a given distance below the membrane connection. As a consequence, a predetermined amount of slack may be provided in the membrane structure at the cable crossover regions to accommodate the movement of the roof during inflation and deflation thereof. However, in an inflated mode, such slack accommodation introduces the undesirable structural trade-off of stress gradients both in the fabric as well as in the associated cable. Such trade-offs are seen to impose overall loading constraints upon the basic pressure criteria of the design analysis of the structure.

SUMMARY

The present invention is addressed to a connector assembly for air-supported roof structures and the like which serves to eliminate the mutually eccentric pivot coupling positions of restraining cable connections with respect to corresponding fabric or roof membrane connections. As a consequence of the improvement, undesirable stress concentrations otherwise extant both in the roof fabric as well as in the restraining cables are substantially eliminated.

Another object of the invention is to provide a connector assembly for roof fabrics and restraining cables utilized in forming an air-supported roof. The restraining cables are mounted for pivotal movement about axes each of which is disposed substantially at the same height as the connection of the fabric with the supporting structure for the roof in the vicinity of the cable. Continuity of connection of the roof fabric is provided by a frame, the periphery of which partially surrounds the cable connection assembly and which is mounted co-pivotally with that cable connection.

Another feature and object of the invention provides improved apparatus for providing cable and fabric pivotal connections for air-supported roof structures which includes a cable connector assembly having a pivotal component configured for attachment with an end of a cable. This pivotal component is associated with an anchoring component which is configured to be structurally fixed to the compression ring or similar support structure. The locations of the pivotal component and anchoring component are such that cable pivoting occurs about an axis disposed substantially at the same height as the connection of the roof membrane of fabric with the supporting compression ring in the vicinity of the cable. Further included is a fabric coupling frame which has a stationary portion suited to be structurally fixed to the support structure and which serves to provide spaced pivot components situated at opposite sides of the above-described cable connector assembly. These pivot components are so located as to define a common pivot axis which is collinear with the pivot axis of the cable connector assembly. In a principal embodiment, the coupling frame includes a pivotal portion which is hingedly coupled with the noted stationary portion and which has a periphery extending continuously about the cable connector assembly. This periphery is configured to provide a continuous attachment with corresponding edges of the roof fabric. To secure the fabric coupling frame against moisture and/or air loss, a flexible boot formed of Neoprene or the like is coupled over the assembly by attachment thereof with periphery of the frame.

Another object of the invention is to provide a frame assembly for pivotally securing an air-supportable roof fabric to a compression ring or support structure at the location of the pivotal coupling of a restraining cable. The assembly includes a stationary portion which is configured for fixed retention to the support and has a generally U-shape providing spaced hinged pivot components, the common axis through which is coincident with the pivotal axis of an associated cable coupling. This axis also is disposed substantially at the same height as the connection of the roof fabric with the supporting structure in the vicinity of the cable. The frame assembly further includes a pivotal frame portion which is joined with the stationary portion at its hinged pivot components and which has a periphery which substantially surrounds an associated cable pivotal coupling.

Other objects of the invention will, in part, be obvious and will, in part, appear hereinafter.

The invention, accordingly, comprises the apparatus possessing the construction, combination of elements and arrangement of parts which are exemplified by the following detailed disclosure.

For a fuller understanding of the nature and object of the invention, reference should be had to the following detailed description taken in connection with the accompanying drawings.

BRIEF DESCRIPTION OF THE DRAWINGS

FIG. 3 is a top view of the stadium of FIG. 1;

FIG. 4 is a partial plan view of a connector assembly according to the invention, showing its coupling with roof fabric;

FIG. 7 is a partial sectional view of a typical cable and fabric connection present in the prior art;

FIG. 8 is a partial sectional view of the connection arrangement of FIG. 7 taken through a plane oriented transversely with the sectional plane of the latter;

DETAILED DESCRIPTION

Figure 1:
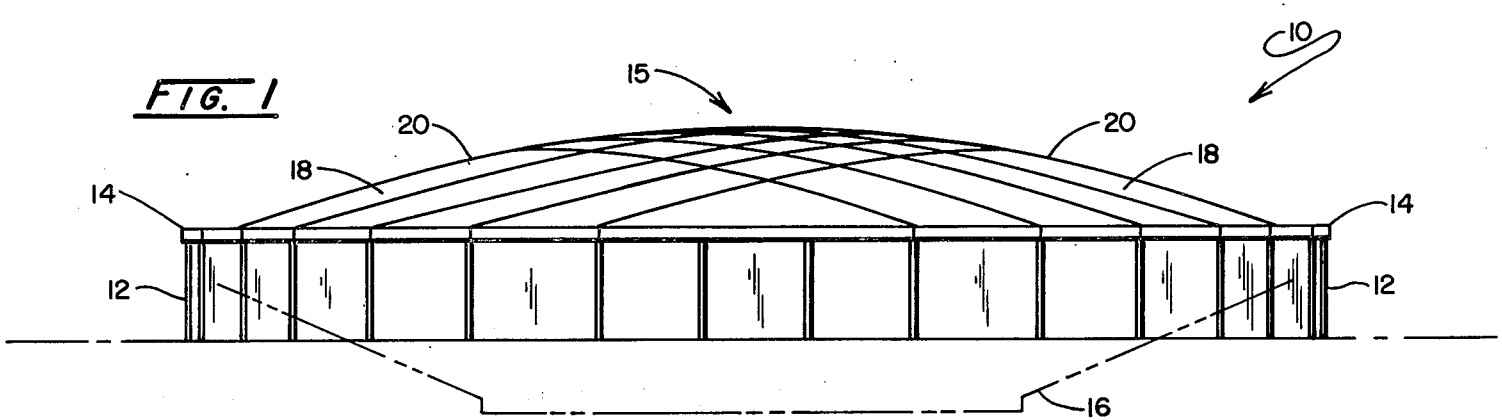
FIG. 1 is an elevational view of a stadium incorporating an air-supported roof structure with an outline, shown by broken lines, of a section of the arena enclosed by the roof structure.

FIG. 1 shows an elevational view of a typical stadium or the like 10 having vertically oriented supporting column-like structure, including the components 12, which retain a compression ring or equivalent supporting structure 14 at a predetermined design level above the arena seats and main exhibition areas. The latter areas are represented at 16 by broken lines. Connected to supporting structure 14 is an air-supported roof structure 15 including glass fiber reinforced panels, certain of which are represented at 18 and which are mutually interconnected and continuously attached in air-secure fashion with the inner periphery of supporting structure 14. As revealed in FIG. 3, panels 18 are connected to and are restrained by a plurality of elongate cables 20 which are associated in a predetermined geometric pattern. The ends of these cables are pivotally coupled to the supporting structure compression ring 14 at established locations. Through the utilization of a plurality of blowers within the building, the entire roof structure is elevated to its raised or operational orientation, the cables 20 restraining the panels 18 in appropriate fashion to derive desired geometry.

Figure 2:
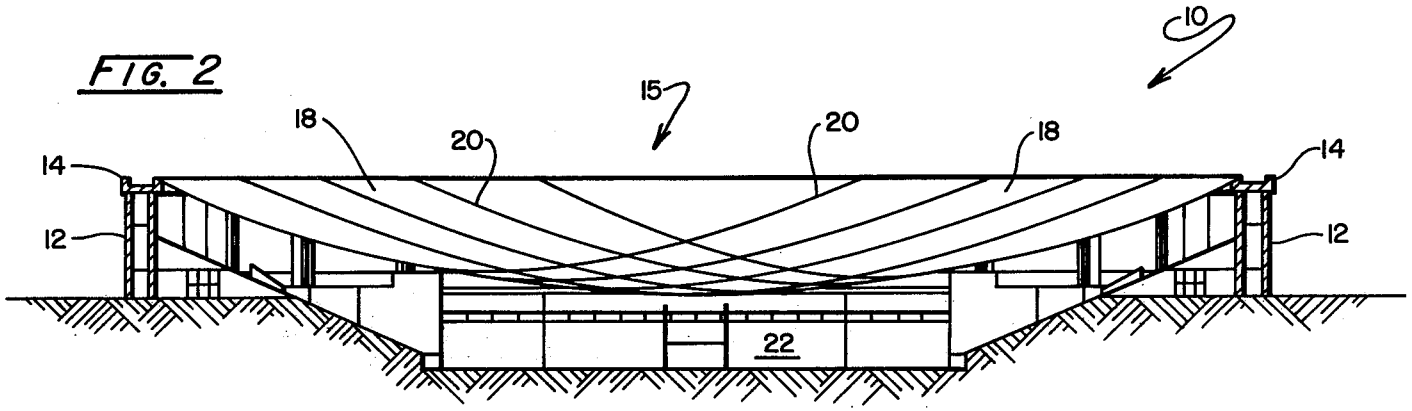
FIG. 2 is a secitonal elevational view of the stadium of FIG. 1 taken through the plane 2—2 of FIG. 3 and showing the roof structure thereof in a down orientation.

FIG. 2 illustrates the stadium 10 in a condition wherein the roof covering 15 is unsupported, the cables 20 hanging from supporting structure 14 in catenary fashion over the enclosed area 22. As is apparent, a pivotal activity of substantial proportion takes place at the coupling of both fabric panels 18 and cables 20 with ring 14 in the course of manipulation of the roof structure 15 between its elevated and its down orientations.

Looking momentarily to FIGS. 7 and 8, the geometric relationship of the fabric or membrane 18 with respect to the pivotal coupling of cables 20 for an exemplary prior art installation is revealed. Cable 20 is connected, for example, through a yoke-type connector or open-end socket 24 to an embedded blade component 26. Component 26, in turn, is structurally reinforced or supported by outwardly extending support extensions 28 and 30 which, alternately, may be present as anchored cable. Yoke 24 is coupled to blade 26 by a pin 32. Fabric 18 is continuously connected to supporting structure 14 at an upwardly disposed planar surface portion 34 thereof above the pin 32 by a plate connector 36 connected thereto as by bolts 38. Note the roped outer structuring 40 at the periphery of all panels as at 18, as well as the U-type clamp 42 utilized for connecting the fabric 18 to cable 20.

As is apparent, when the roof structure is maneuvered between its operational (up) and its non-inflated (down) orientations, stresses will develop in those regions where the panels 18 cross over the pivotal connections of cable 20 with supporting structure 14. Usually, a predetermined amount of slack is provided in the panels 18 at these cross-over regions, this form of design accommodation leading to the development of stress gradients and limitations upon the overall pressure related design of the structure.

As is apparent from the top view of roof structure 15 revealed in FIG. 3, a considerable number of the above discussed pivotal cable connection points are provided in any given air-supported roof structure and, in accordance with the instant invention, an assembly is provided which eliminates the eccentric relationship between the pivotal coupling of cable 20 and the continuous pivotal connection of panels 18 with the supporting peripheral structure 14. As shown in FIG. 4, an edge of each of the outwardly disposed fabric panels is connected in air-tight fashion along a generally horizontal common plane with a surface of supporting structure 14 through the use of tie-down plates 36 as described earlier. Connection through the utilization of plates 36 is made in continuous fashion between points of connection of cables 20. At each of these connection positions, an assembly fashioned in accordance with the invention, revealed generally at 50, is encountered.

Figure 5:
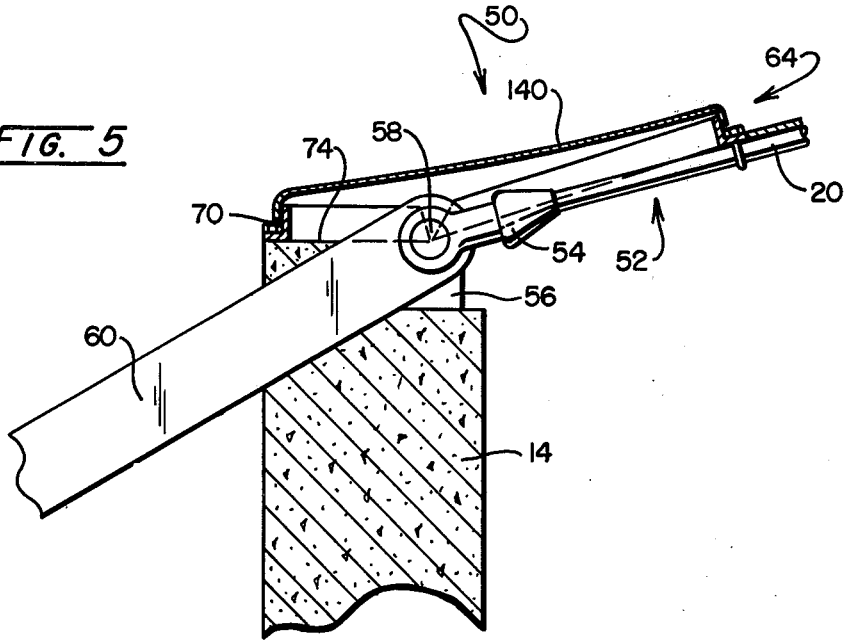
FIG. 5 is a partial sectional view of the assembly of FIG. 4 taken through the plane 5—5 thereof.
Figure 6:
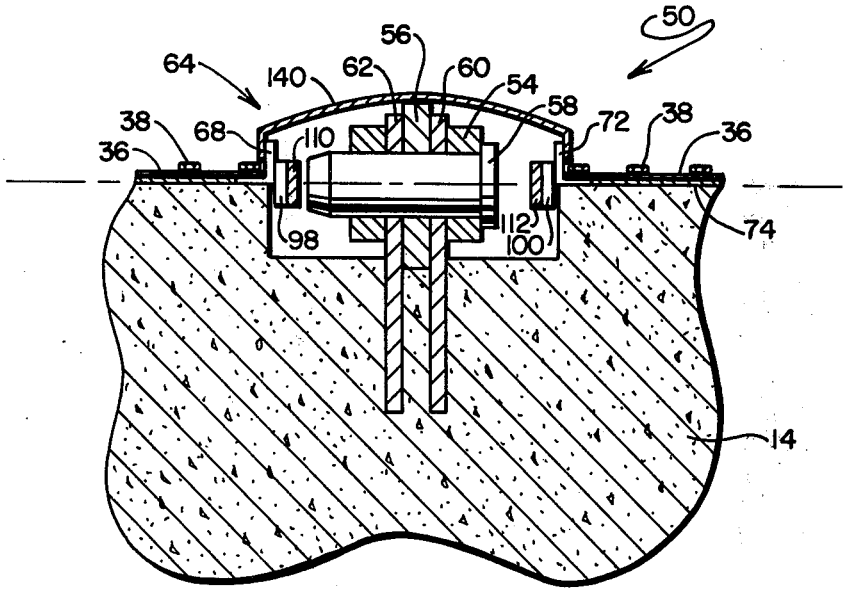
FIG. 6 is another partial sectional view of the assembly of FIG. 4 taken through the plane 6—6 thereof.
Figure 9:
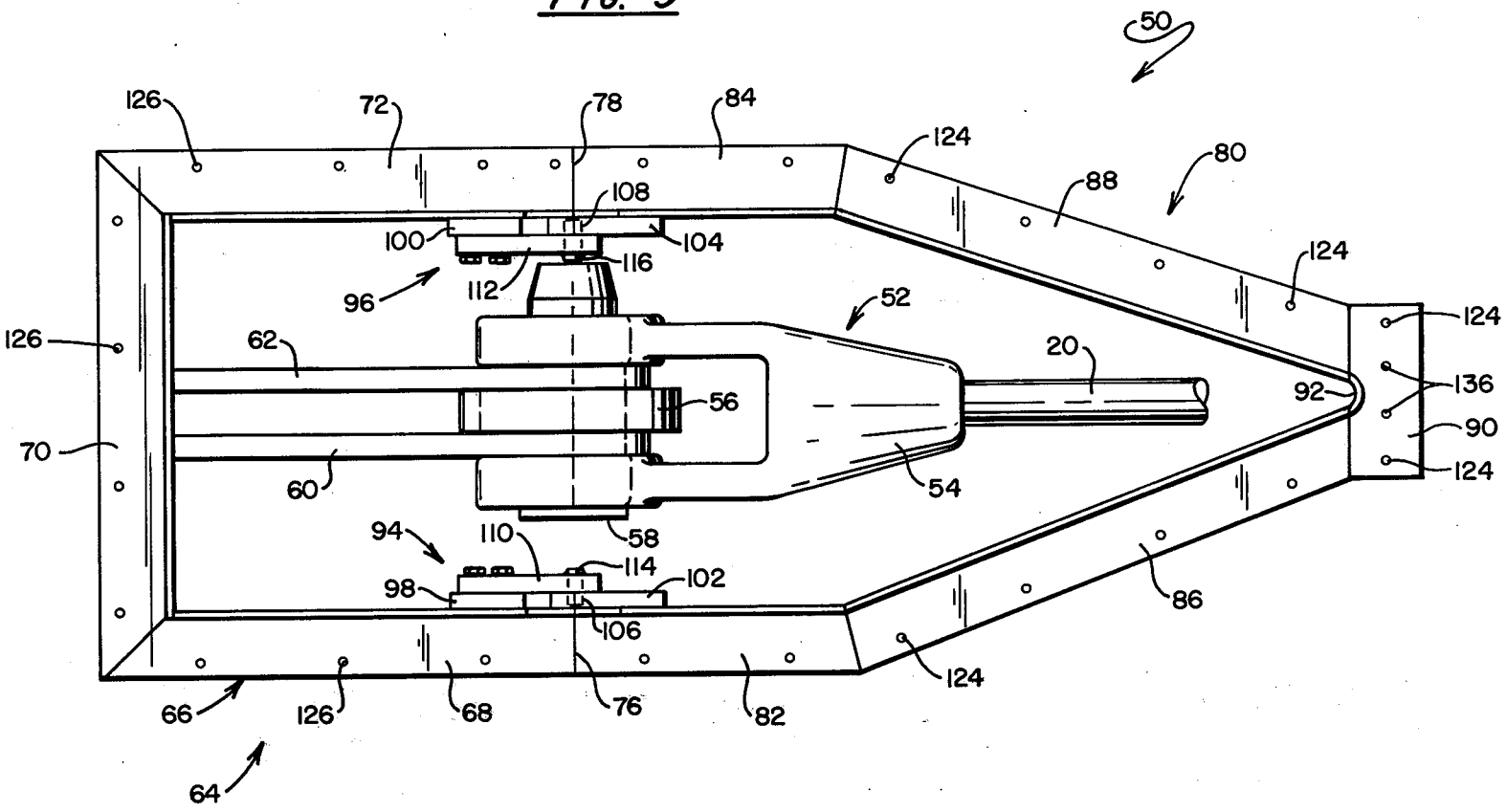
FIG. 9 is an enlarged plan view of the connector assembly according to the ivnention.

Referring to FIGS. 5, 6 and 9, initially it may be observed that a cable connector assembly 52 is provided which serves to pivotally connect a cable 20 to supporting structure 14 for pivotal movement about an axis disposed substantially at the same height as the connection of fabric panels 18 to that structure in the vicinity of the cable. In this regard, the figures reveal an open end socket or yoke-type connector 54 threadably attached to cable 20 and having extending arms which are pivotally connected with a blade component 56 embedded within structure 14. Pivotal connection is provided through the use of a pin 58, the longitudinal axis of which is disposed substantially at the same height as the connection of the appropriate ones of fabric panels 18 with structure 14 in the vicinity of the cable. In conventional fashion, supporting extensions 60 and 62 provide structural buttressing for component 56, the extensions being provided with apertures for receiving the pin 58.

Figure 10:
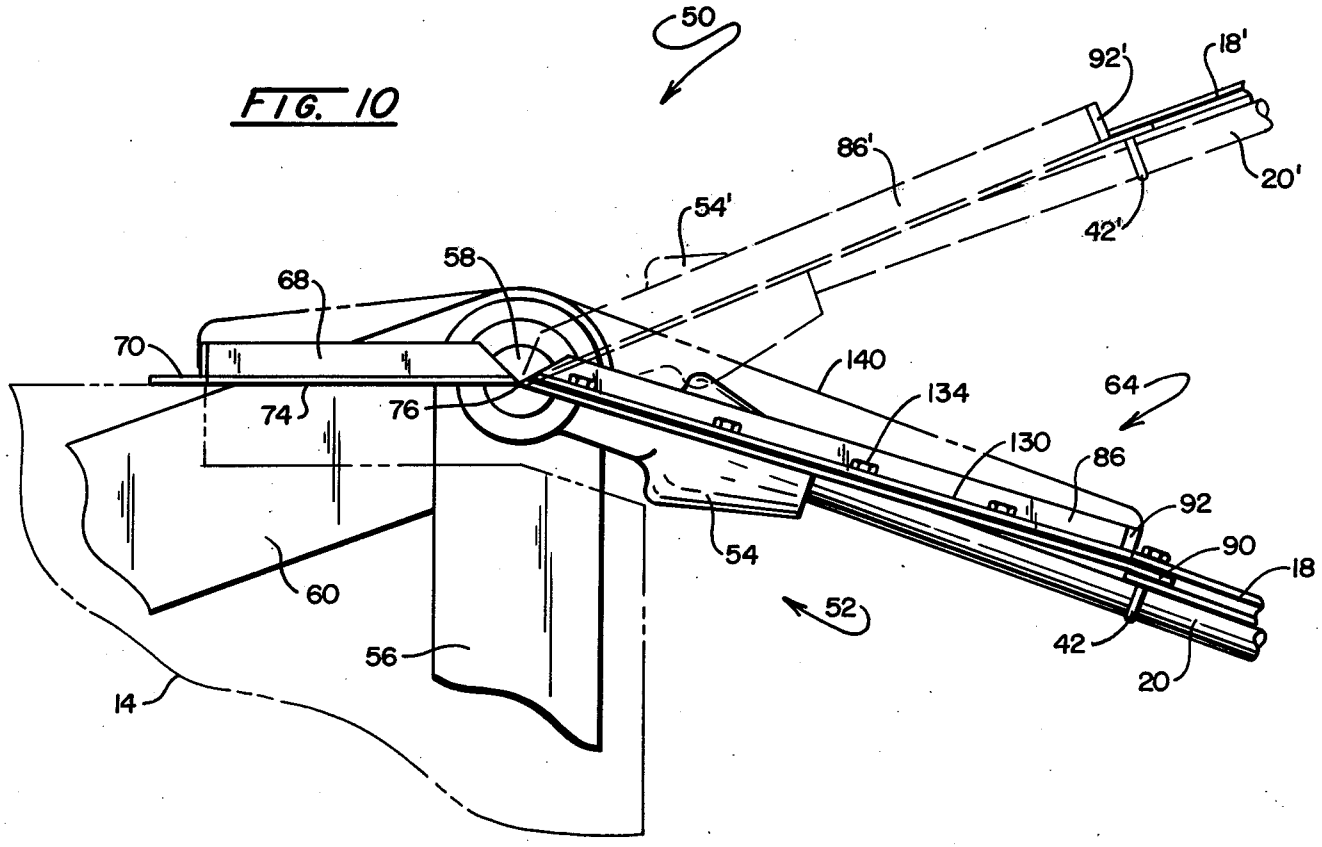
FIG. 10 is a partial side view of the assembly of FIG. 9 showing, in alternate fashion, the raised or operative and down positions thereof.

As is revealed in detail in FIG. 9 and looking additionally to FIG. 10, assembly 50 also includes a fabric coupling frame assembly revealed generally at 64. Assembly 64, shown formed of angle stock the size of which depends upon the design loads involved, includes a generally U-shaped stationary portion 66 formed of three components 68, 70 and 72 having outwardly extending flange portions which rest upon and are anchored to the upwardly disposed surface 74 of supporting structure 14. Connection of portion 66 may be provided in conventional structural anchoring fashion, as by welding to embedded steel members. Components 68 and 72 also include upstanding or upwardly extending flange components which, at the ends of the U-shaped structure, are tapered downwardly at about a 45° angle extending to pivot lines shown respectively at 76 and 78. These pivot lines or axes are mutually coincident as well as coincident with the central axis of pin 58, the axis of pivotal connection of cable 20 to structure 14.

Frame assembly 64 further includes a frame pivotal portion shown generally at 80 fashioned of two spaced parallel angle components 82 and 84, the upstanding flange portions of which are tapered at about a 45° angle to extend to respective pivot lines 76 and 78. Components 82 and 84 are aligned with respective components 68 and 72 of stationary portion 66 and, in turn, are attached to corresponding angle stock components shown respectively at 86 and 88. The latter components extend in V-shaped fashion to and are attached to an apex plate 90. A smooth continuation of the outwardly disposed surfaces of the upstanding flange portions of components 86 and 88 at apex plate 90 is provided by weldably attaching a pipe section 92 thereto. Connection between components 82 and 86 as well as components 84 and 88 is by welding and the connection of apex plate 90, as well as pipe section 92 in the assemblage, additionally is by welding. As is apparent, the upwardly disposed surfaces of the outwardly extending flanges of angle of components 82, 84, 86 and 88 are co-planar, being intended for attachment with the fabric of adjacent panels 18.

Frame pivotal portion 80 is hingedly connected to stationary portion 66 by two identical hinge assemblies 94 and 96. Assemblies 94 and 96 each incorporate a buttressing plate, shown respectively at 98 and 100 which is welded to the upstanding flanges of respective components 68 and 72. Similarly, socket plates 102 and 104 are weldably attached to the upstanding flanges of respective components 82 and 84. Plates 102 and 104 are provided with blind holes or sockets, shown respectively at 106 and 108, which, upon installation of the assembly, are axially aligned with the central axis of pin 58. Buttressing plates 98 and 100 each contain spaced tapped holes suited to provide bolted connections, as shown in FIG. 9, to hinge pin assemblies illustrated respectively at 110 and 112. Assemblies 110 and 112 are fashioned from plate stock and have tapered forwardly disposed ends, the latter having holes which receive and are weldably connected to outwardly extending hinge pins shown respectively at 114 and 116. With the arrangement shown, pivotal portion 80 is hingedly connected to stationary portion 66 by bolting assemblies 110 and 112 to respective buttressing plates 98 and 100, hinge pins 114 and 116 being inserted within corresponding sockets 106 and 108 in the course of such connection. As is apparent, pivotal portion 80 is capable of pivoting about lines 76 and 78 which extend in coaxial fashion with the pivotal connection of cable 20 through yoke or clevis assembly 54 and blade 56.

It may be observed that spaced about the periphery of the frame pivotal portion 80 of assembly 50 are a series of tapped holes 124. Similarly, the stationary portion 66 of the frame incorporates a series of spaced tapped holes 126. Holes 124 are provided for the attachment of fabric connection pressure plates as are revealed in FIG. 4 at 128, 130 and 132. As evidenced in that Figure, the fabric panels 18 are precut and provided with "roped" edges which conform to the general peripheral dimensions of pivotal frame portion 80. The roped edge periphery of the fabric resides adjacent the upstanding flange components of members 82, 84, 86 and 88. Bolts 134, threadably engaging holes 124, retain the pressure plates in position against the fabric to provide a continuous secure connection with the fabric across assembly 50. In addition to tapped holes 124, apex plate 90 of the assembly also incorporates untapped holes 3 which, as revealed in connection with FIG. 10, retain a U-type connector 42 which serves to secure the outward end of pivotal frame portion 80 to cable 20.

As revealed in FIGS. 4, 5 and 6, the opening defined by the upstanding flange components of assembly 50 which surrounds cable connector assembly 52 is covered by a flexible, moisture-impermeable boot 140. Formed for example of Neoprene, boot 140 may be coupled to frame pivotal portion 80 utilizing the same pressure plates 128, 130, 132 serving to retain fabric panels 18. Similar pressure plates may be utilized in conjunction with tapped holes 126 in conjunction with stationary portion 66 to retain the rearwardly disposed portion of the boot in position. Alternately, the boot may be attached to the upstanding flanges of the components of assembly 50 utilizing retainer plates (not shown).

Preferably the boot 140 is attached to the frame assembly as a preliminary step, following which the appropriate peripheries of roof fabric panels 18 are positioned thereover. Subsequent to the latter positioning, the pressure plates as described at 128–132 are assembled and the composite assembly then provides a moisture secure arrangement. Of particular advantage, the Neouprene boot 140, being positioned at the bottom of the composite, serves as a cushion for the superimposed fabric periphery.

As is apparent from the Figures, when connector assemblies 50 are installed, there panels 18 connected to support structure 14 are permitted to pivot in continuous and substantially uninterrupted fashion across each of the cable connector assemblies 52. Additionally, the frame assembly 64 permits the fabric or membrane to pivot about an axis coincident with the pivoting axis of the cable assemblies 52 without the build-up of stress concentrations or the like. This desirable performance is illustrated more clearly in FIG. 10 where the various components of assembly 50 are represented in solid-line fashion for a condition wherein the roof structure 15 is in its down or nonsupported orientation and in broken-line fashion in the air-supported operation and orientation thereof. In the Figure, identical components for the latter, operative orientation are represented by identical but primed numeration. Note that the pivot axis for both fabric panel 18 and cable 20 remains identical throughout all orientations of the roof structure between inflated and deflated positions.

As is apparent from the foregoing, the connecting arrangement of the invention permits a diversion of the attachment of roof fabric around each cable connection to provide a uniformity of stress at these cable connecting locations. The arrangement further provides a common pivot axis for both the cable connection and the fabric coupling with the compression ring or supportive structure.

It will be apparent that the frame pivotal portion 80 of the assembly 50 could have a hinge coupling unitary or integrated with the pivotal coupling of the cable, thus avoiding the need for separately installed cable end fitting assemblies and fabric retaining frames.

While the invention is particularly useful in conjunction with air-supported membrane roof structures, the cable and fabric connecting apparatus may also be used in membrane roofs supported by tension in the cables if for any reason it is desired to have pivotal connections.

While the upper surface 74 of the supporting ring 14 is shown in a horizontal plane, it is understood that this surface may include segments inclined upwardly or downwardly toward the connecting assemblies 50.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. In a roof structure of a variety wherein a roof membrane is continuously coupled with an upper surface of a fixed support structure peripherally disposed about an area to be enclosed and a plurality of cables are pivotally connected with said support structure at predetermined locations therealong for restraining said membrane, the improved apparatus for providing cable and membrane connections at one of said locations, comprising:

a cable connector assembly including a pivotal component configured for attachment with an end portion of a cable and an anchoring component configured to be structurally fixed to said support structure, said pivotal component and said anchoring component being further configured for the mutual pivotal coupling thereof to permit pivotal movement of the pivotal component about an axis disposed substantially at the same height as the connection of the membrane to the support structure in the vicinity of the cable; and a membrane coupling frame including a stationary portion configured to be structurally fixed to said support structure and to provide spaced pivot components situated at opposite sides of said cable connector assembly, said pivot components defining a common pivot axis substantially collinear with the axis of pivotal movement of the pivotal component of the cable connector assembly, and a pivotal portion hingedly coupled with said stationary portion at said spaced pivot components, having a periphery extending continuously about the pivotal component of said cable connector assembly and configured for corresponding continuous attachment with said membrane at said predetermined location.

2. The improved apparatus of claim 1 including means for connecting the pivotal portion of said membrane coupling frame with an associated cable.

3. The improved apparatus of claim 1 in which the pivotal portion of said membrane coupling frame is present as angle stock having substantially a continuous outwardly extending flange component, and including means for connecting said membrane thereto, said outwardly extending flange component being in parallel planar relationship with said membrane when connected thereto and hingedly coupled with said stationary portion.

4. The improved apparatus of claim 3 in which:

the pivotal portion of said membrane coupling frame is present as angle stock having a flange component extending upwardly from said outwardly extending flange component and defining an opening about the pivotal component of said cable connector assembly;

said apparatus including a moisture impermeable flexible cover positionable over said opening; and including means for connecting said cover with said outwardly extending flange component.

5. The improved apparatus of claim 4 in which:

the stationary portion of said membrane coupling frame is present as angle stock having an upwardly extending flange component defining an opening;

said moisture impermeable flexible covering additionally is configured to be positioned in covering relationship over said opening; and including means for connecting said covering with said outwardly extending flange of said stationary portion.

6. The improved apparatus of claim 5 wherein the stationary portion of said membrane coupling frame is U-shaped, said pivot components being positioned at the open-end portions of said shape.

7. A frame assembly for pivotally securing an air-supportable roof fabric to a support structure at the location of a pivotal coupling of a restraining cable to said structure comprising:

a frame stationary portion configured for fixed retention to said support structure and having spaced hinge pivot components, the common axis through which is coincident with the axis of the pivotal coupling of said cable when said stationary portion is fixed to said support structure; and a frame pivotal portion pivotally joined with said stationary portion at said hinge pivot components, having a periphery substantially surrounding said pivotal coupling of the cable and connectable with said roof fabric.

8. The frame assembly of claim 7 in which two said hinge pivot components are present and said frame stationary portion is configured for positioning said two spaced hinge pivot components in adjacency with said restraining cable when said stationary portion is mounted upon said support structure.

9. The frame assembly of claim 8 in which said frame stationary portion is U-shaped, said hinge pivot components being located at the open end portions of said shape.

10. The frame assembly of claim 8 in which said frame pivotal portion is configured to define a continuous periphery extending from one said hinge pivot component to the other.

11. The frame assembly of claim 10 in which:

said frame pivotal portion periphery is extensible around at least a portion of the pivotal coupling of said restraining cable; and including a moisture impermeable flexible cover connectable with said periphery.

12. The frame assembly of claim 10 in which said frame pivotal portion is present as angle stock.

13. The frame assembly of claim 10 including means for coupling said frame pivotal portion to said restraining cable.

14. In an air-supported roof structure of a variety wherein an air-supportable fabric is continuously coupled with substantially air-tight integrity with an upper surface of a fixed support structure peripherally disposed about an area to be enclosed and a plurality of cables are pivotally connected with said support structure at predetermined locations therealong for restraining said fabric, the improved apparatus for providing cable and fabric connections at one of said locations, comprising:

a cable connector assembly inculding a pivotal component configured for attachment with an end portion of a cable and an anchoring component configured to be structurally fixed to said support structure, said pivotal component and said anchoring component being further configured for the mutual pivotal coupling thereof to permit pivotal movement of the pivotal component about an axis disposed substantially at the same height as the connection of the fabric to the support structure in the vicinity of the cable; and a fabric coupling frame including a pivotal portion hingedly connected with said support structure for pivotal movement about an axis substantially coincident with the axis of pivotal movement of the pivotal component of said cable connector assembly, having a periphery extending continuously about said pivotal component of said cable connector assembly, and configured for corresponding continuous attachment with said fabric at said predetermined location.

15. The improved apparatus of claim 14 including means for connecting the pivotal portion of said fabric coupling frame with an associated cable.

16. The improved apparatus of claim 14 in which the pivotal portion of said fabric coupling frame is present as angle stock having substantially a continuous outwardly extending flange component, and including means for connecting said fabric thereto, said outwardly extending flange component being situated in parallel planar relationship with said fabric when connected thereto.

* * * * *